US006736195B2

(12) United States Patent
Busch et al.

(10) Patent No.: US 6,736,195 B2
(45) Date of Patent: May 18, 2004

(54) COOLING FIN ARRANGEMENT

(75) Inventors: Matthias Busch, Meersburg (DE); Thomas Tauschel, Owingen (DE); Christian M. Tilly, Uhldingen (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 09/882,775

(22) Filed: Jun. 15, 2001

(65) Prior Publication Data

US 2001/0052410 A1 Dec. 20, 2001

(30) Foreign Application Priority Data

Jun. 15, 2000 (EP) ..... 00112677

(51) Int. Cl.[7] ..... F28F 13/12
(52) U.S. Cl. ..... 165/109.1; 165/185
(58) Field of Search ..... 165/109.1, 185, 165/86

(56) References Cited

U.S. PATENT DOCUMENTS

| | | | | | |
|---|---|---|---|---|---|
| 2,345,017 | A | * | 3/1944 | Tack | 188/218 XL |
| 3,575,269 | A | * | 4/1971 | Sherman | 192/58.4 |
| 3,732,953 | A | * | 5/1973 | Huet | 188/218 XL |
| 3,921,711 | A | | 11/1975 | Westbrock | 165/109 |
| 4,164,993 | A | * | 8/1979 | Kobelt | 188/218 XL |
| 4,469,203 | A | * | 9/1984 | Herbulot et al. | 188/218 XL |
| 4,678,070 | A | * | 7/1987 | Light | 192/113.21 |
| D322,075 | S | * | 12/1991 | Jennings et al. | D15/5 |
| 5,975,265 | A | * | 11/1999 | Moser | 192/113.21 |

FOREIGN PATENT DOCUMENTS

| | | |
|---|---|---|
| DE | 19618627 | 11/1977 |
| DE | 2503489 | 8/1979 |
| DE | 19511665 | 10/1996 |

* cited by examiner

*Primary Examiner*—Allen Flanigan
(74) *Attorney, Agent, or Firm*—Fitch, Even, Tabin & Fannery & Greg Dziegielewski

(57) ABSTRACT

A containment (5) for a heat producing device has cooling fins (15) to dissipate the produced heat. In this type of cooling fin arrangement the cooling fins comprise, traditionally, smooth outer surfaces (17) so that in a boundary layer (18) the flow pattern of the cooling fluid along the cooling fins is laminar.

The present invention provides means (20) to break this laminar flow pattern in the boundary layer and herewith improves the heat transfer from the cooling fins to the cooling liquid.

This invention can advantageously be applied to viscous fan clutch covers.

13 Claims, 4 Drawing Sheets

COOLING FIN ARRANGEMENT

BACKGROUND OF THE INVENTION

The present invention comprises a cooling fin arrangement on a cooling fluid-receiving surface of an object made of heat conductive material such as a portion of a containment in which heat is produced and is to be dissipated by means of said fin arrangement, comprising a plurality of cooling fins in a manner so as to obtain that said fluid flow, at least partially, moves in between said cooling fins.

The present invention has applications to a great variety of such heat dissipating containments and will be described hereinafter for reasons of simplicity only with reference to a cover of a so-called viscous fan, it being understood that the present invention does not relate in particular to said viscous fan but to any type of heat dissipating containments which comprise cooling fins which favorise the transfer of the heat to a cooling fluid, which, in the case of the reference viscosity fan clutch will simply be the ambient air which impinges on the viscosity fan clutch during movement of the vehicle in which the fan is installed.

With reference to FIGS. 1 and 2 appended hereto, illustrating the prior art, FIG. 1 shows a typical fan assembly for a motor vehicle, comprising two concentric rings 2 and 3 between which a number of fan blades 4 are arranged in radial extension.

Axially inside thereof, the fan assembly comprises a viscosity clutch, from which only the cover 5 is visible, comprising a number of radially arranged cooling fins 6.

Typically this kind of fan arrangement is used in a vehicle in order to cool the cooling fluid of the engine, whereas the axis of the fan assembly is parallel to the length axis of the vehicle, however other arrangements may be envisaged.

Since the cooling power needed in order to cool a vehicle engine is dependent on operation conditions, such as outside temperature, ratio of vehicle speed to rotational speed of the engine and so forth, modern fan arrangements comprise a viscous clutch which transmits a variable momentum from the driving axis (not illustrated in FIG. 1) to the fan blades, whereby the operation of a viscosity clutch does not form part of the present invention and does not need to be described here in detail.

However in a few words, a viscosity clutch comprises two co-axial plates having a certain axial distance from each other, whereby this distance may be filled either with air, or with oil, and whereby the amount of oil present in the space between the two plates determines the ratio between input momentum and output momentum.

This type of viscosity clutch naturally produces heat, the so-called slip-heat, during its operation, which heat needs to be dissipated through the clutch cover 5 which carries radially arranged cooling fins 1 (see FIG. 2) spaced from each other by fluid channels 12.

FIG. 2 illustrates a perspective view of a portion of a clutch cover 5, as seen from a direction corresponding to arrow A of FIG. 1.

Naturally, the man of the art who designs a clutch cover for a viscosity clutch of the type as referred to above, will try to obtain the best possible heat transfer from the clutch cover to the surrounding air in order to improve the effectiveness of the clutch, and he will thus calculate the height, thickness, number and so forth of cooling fins on the surface of the clutch cover in a way as to optimise the heat transfer.

It is readily understandable that the heat transfer will be the better, the more cooling fins are present over the surface to be cooled, however, the present inventors have found that there is a limit of efficiency obtained by increasing the density of cooling fins.

Also, when a fluid flows along a smooth surface, irrespective of the overall configuration of the flow channel, a surface layer is being formed within which the flow is laminar.

SUMMARY OF THE INVENTION

The present invention, which has as objective to increase the heat transfer from, the cooling fins to the cooling fluid is therefore based on the discovery that on the one hand the heat transfer is enhanced if one changes from a laminar flow to a turbulent flow, and on the other hand, if one provides means which, although the present geometry would create a laminar flow, this geometry may be voluntarily modified in order to create a turbulent flow, within the above mentioned surface layer.

This object is achieved with a cooling fin arrangement according to the preamble of claim 1, characterized in that turbulence-creating formations are provided in said cooling fin arrangement so as to obtain a non-laminar flow of said cooling fluid within the above mentioned surface layer.

According to a particular embodiment of the present invention, these turbulence-creating formations may be protuberances of the surfaces of the cooling fins.

These protuberances may be formed integrally with the cooling fins, or be formed by wires or profiled bars which are fastened to the cool surfaces of the cooling fins by welding or the like and which extend perpendicular to the length dimension of said fins essentially perpendicular to the fluid flow.

In a particular embodiment of the present invention, said protuberances may comprise at least one embodiment which is oriented substantially perpendicular to the flow of the cooling fluid whereby the surface of said protuberances which is exposed to said fluid flow is arranged in angular relationship to said fluid flow.

The elevation of said protuberances above the surface of the cooling fins can of course be calculated so as to obtain a turbulent flow as soon as a certain fluid speed is achieved.

These protuberances may alternatively have the shape of individual balls or plates which are oriented perpendicular to the surface of the cooling fins but angled with respect to the fluid flow.

The present invention also relates to a containment of heat conductive material of or for a device which produces heat during its operation, wherein the outer surface of said containment comprises cooling fins which extend in any desired pattern over said outer surface and which represent a plurality of web-like structures. Said cooling fins, which are connected at one of their edges with said outer surface of said containment from where they extend in essentially perpendicular direction, comprise on at least one of there two flat surfaces turbulence-creating formations so as to obtain that the flow of the cooling fluid within the surface layer of the cooling fins created by more or less parallel webs, is turbulent.

As outlined at the beginning of the present description, the containment on which a cooling fin arrangement according to the present invention may be used, can be one of a variety of heat dissipating enclosures, whereas the cover of a viscous fan clutch of a vehicle fan arrangement is a typical example.

In this embodiment of a viscosity fan clutch of a vehicle the cooling fluid can be the ambient air which impinges during movement of the vehicle axially on the cover of the fan clutch, whereafter the air is led radially outwardly following trajectories formed between cooling fins which are arranged radially outwardly from a central point.

BRIEF DESCRIPTION OF THE DRAWINGS

The present invention will now be described in more detail with reference to the drawings, whereby.

DETAILED DESCRIPTION

Figure 1:
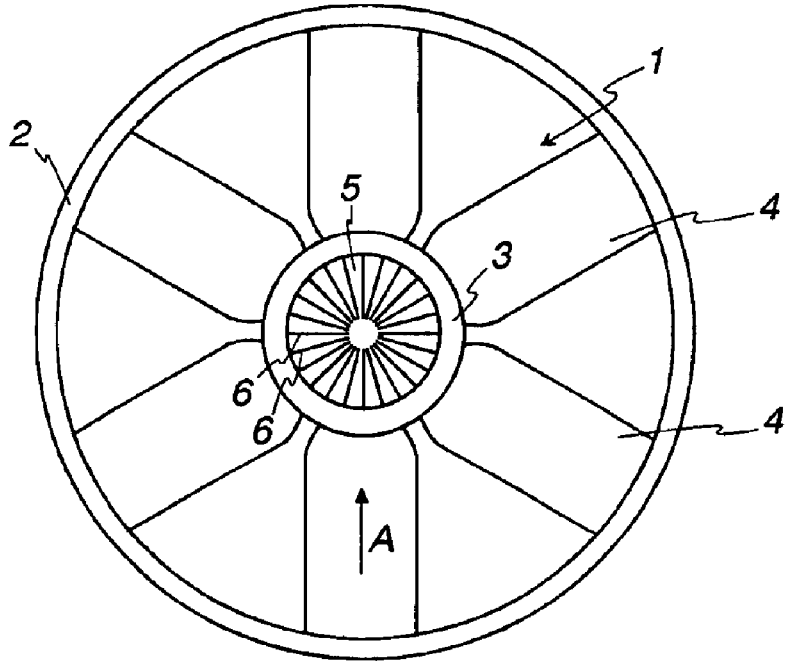
FIGS. 1 and 2 illustrate a conventional fan assembly including a heat dissipating cover of a viscous fan clutch, FIG. 3 traditional cooling fin assembly as well as a cooling fin assembly modified according to the present invention.
Figure 2:
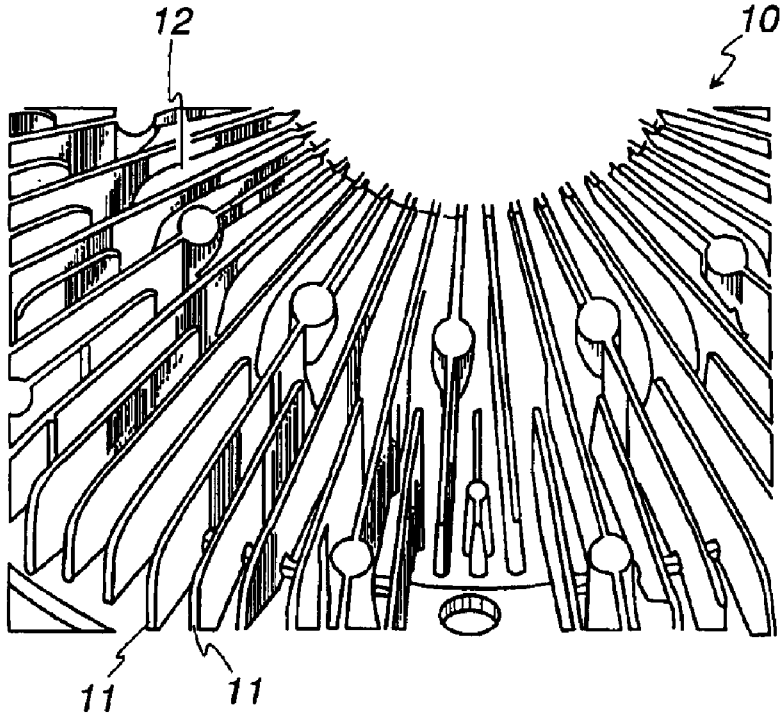
Figure 3:
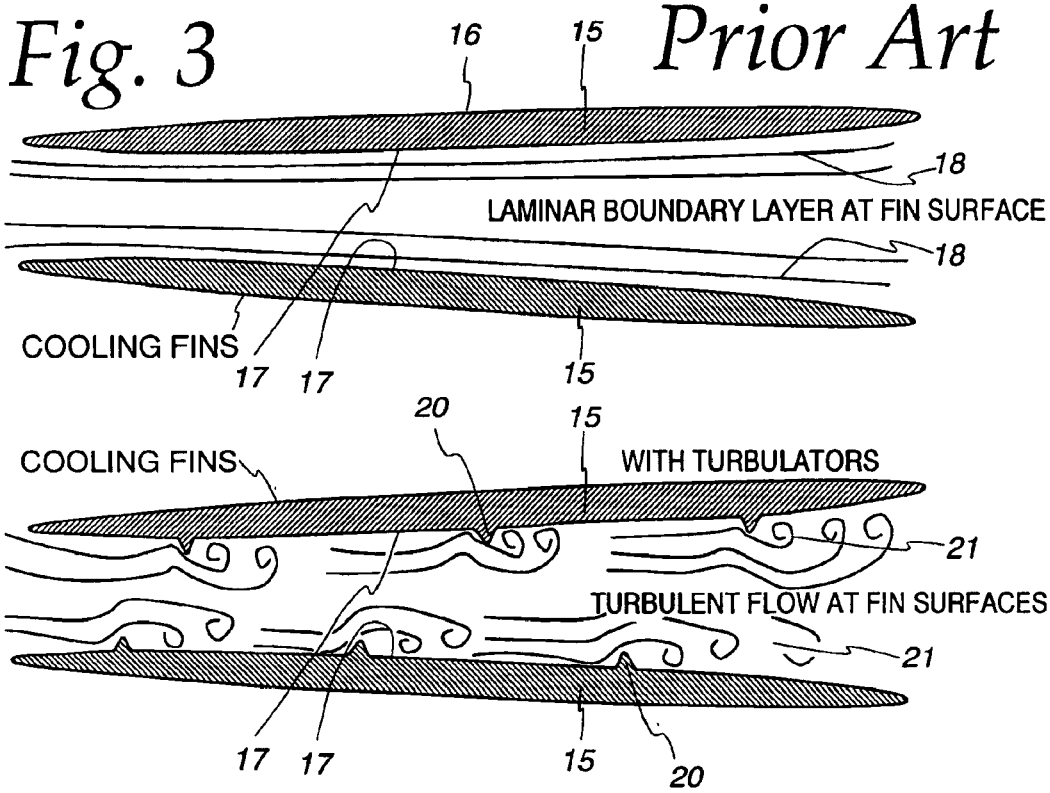
Fig. 3 Prior Art

After having described the principles of a conventional fan assembly including a viscosity fan clutch with reference to FIGS. 1 and 2, we now turn to FIG. 3 wherein the upper portion illustrates two radially extending cooling fins 15 in cross sectional view, whereby the drawing plain corresponds to the main plain of the clutch cover and the cooling fins 15 extends perpendicular therefrom towards the viewer.

Two adjacent cooling fins 15 have side surfaces 17 opposing each other, in between which a cooling fluid will flow and the difference of temperature between the cooling fluid and the surface of the cooling fins will cause heat to be transferred from the cooling fins to the cooling fluid and thus cool the fins and in turn the clutch cover.

As indicated with reference 18, the fluid flow, in a boundary layer, will have a laminar flow pattern, whereas the inventors of the present application have found that the heat transfer from the cooling fins to the cooling fluid can be improved if a turbulent flow pattern can be established.

The inventors have therefore devised an auxiliary means which creates turbulences within the boundary layer and thus improves the heat transfer from the cooling fins 15 to the cooling fluid.

The inventors of the present application have found that by providing disruptive elements 20 on the surface of the cooling fins, the laminar structure of the cooling fluid flow can be sufficiently disrupted so as to create turbulences and thereby increase the heat transfer from the cooling fins to the turbulent fluid flow.

These disruptive elements, which the inventors have named "turbulators" can consist either of individual elements scattered over the surface of the cooling fins, or wires or bars which are arranged in certain configurations across these surfaces.

In the lower portion of FIG. 3, one can see triangles 20 which represent cross sections of prismatic bars which are either welded to the surface of the cooling fins, or which are introduced into positive rails provided on the surface of these fins, or fixed to the fins in any other appropriate manner.

As one can see in FIG. 3, the fluid enters a channel between two adjacent cooling fins on the side on which the distance between the ends of the two adjacent cooling fins is smaller, and, after impinging onto the turbulators 20, the fluid pattern changes from laminar to turbulent.

Figure 4:
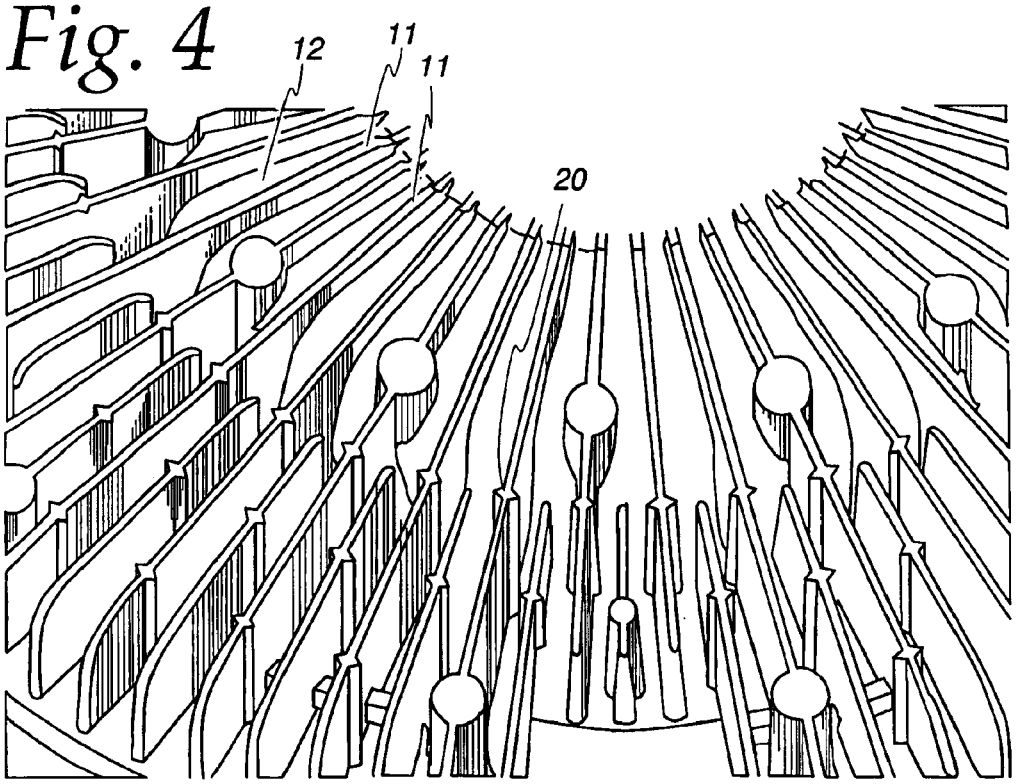
FIG. 4 shows a perspective view of a clutch cover modified according to the present invention.

FIG. 4 illustrates a clutch cover in the same way as FIG. 2, whereby FIG. 4 includes turbulators in form of triangular bars which are arranged in integral manner on the side surfaces of the cooling fins 11.

Going back now to FIG. 1, it has to be understood that during motion of the vehicle, the air will impinge axially onto the front face of the clutch cover 5 from where it is guided radially outwardly following the channels 12 (FIG. 4) formed between cooling fins 11, so that the flow direction of the cooling fluid is radially outwardly and the turbulators 20 in FIG. 4 are arranged so as to break the laminar flow of this cooling air which streams along the surface of the cooling fins.

The arrangement of the turbulators is thus, that the surface of the turbulators 20 (FIG. 3) onto which the cooling fluid impinges, is oriented angularly to the flow direction, however the length extension of the turbulators, as far as they extend across the side surface of the cooling fins, is more or less perpendicular to the fluid flow.

Without departing from the scope and spirit of the present invention, it will of course be possible to optimize the shape, number, direction and size of the turbulators in order to obtain a maximisation of the improvement of the heat transfer between the cooling fins and the cooling fluid, and it is not the objective of the present application to describe an exhausting number of such shapes and configurations, but only to disclose the overall principle of providing a means capable to break the laminar fluid pattern into a turbulent pattern and to herewith increase the heat transfer. Any such configuration lies within the skill of the average man in the art.

Figure 5:
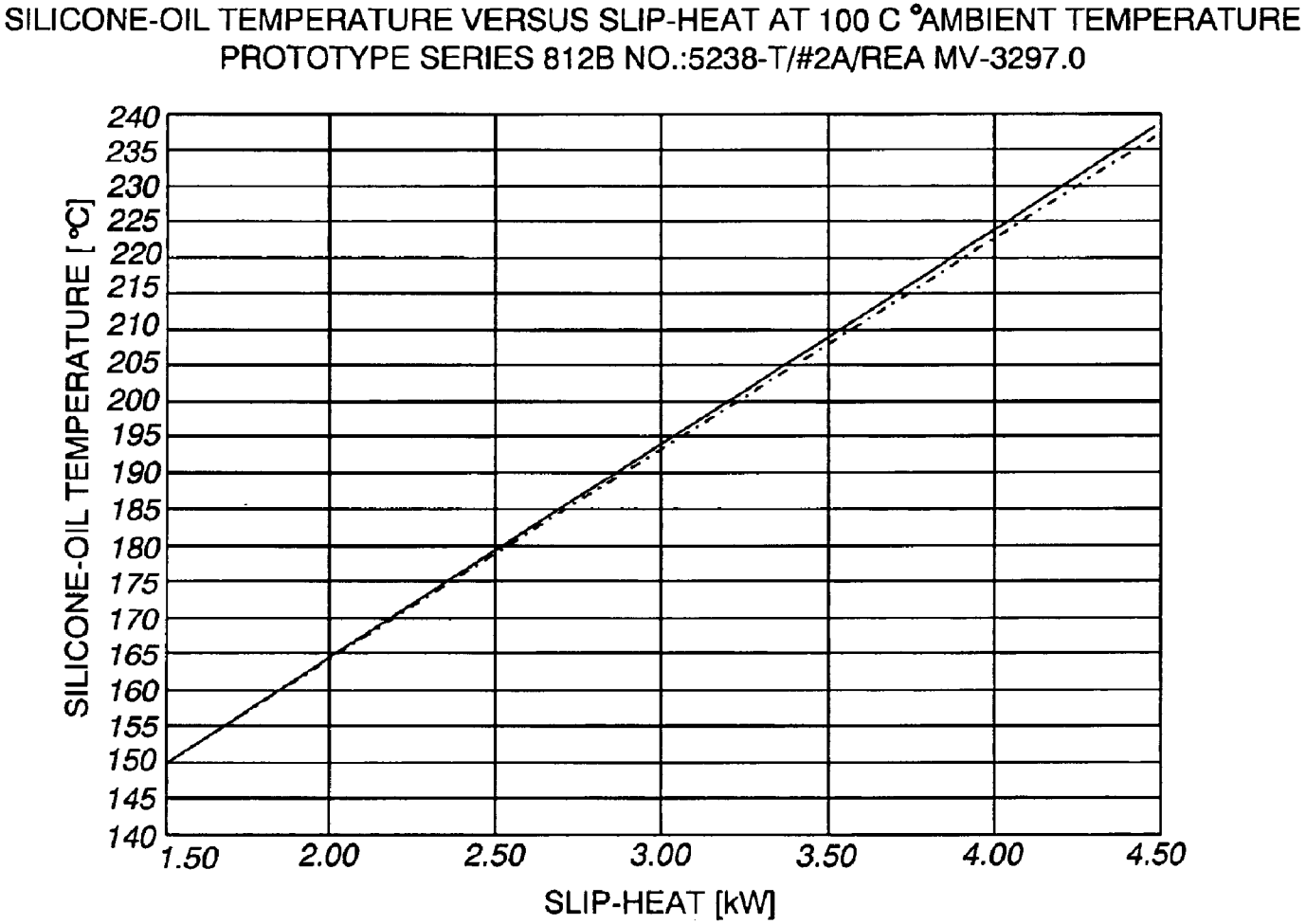
FIG. 5 shows a graphic illustrating the dependence of the slip heat on the silicon oil temperature for a conventional viscosity clutch and for a viscous clutch according to the present invention.
Figure 6:
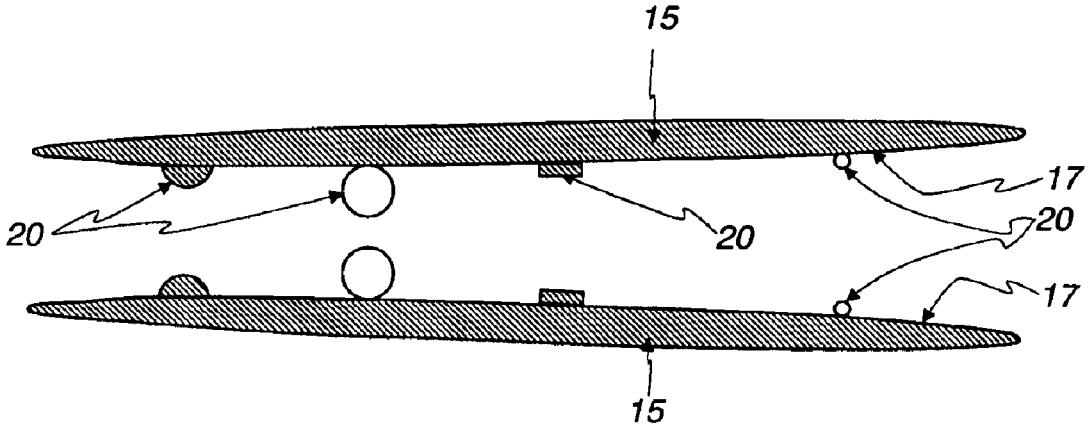

FIG. 5 shows the dependence of the slip heat of a viscosity fan clutch on the temperature of the silicone oil which is present in between the two clutch plates, whereas the full line designates this dependency in the environment of a conventional clutch cover which produces a laminar flow of the cooling fluid in between the cooling fins or at least in boundary layers, whereas the dash dotted line illustrates this dependency for a clutch cover according to the present invention, in which the heat transfer from the clutch cover to the ambient air has been improved by breaking the laminar flow into a turbulent flow, and thereby decreasing the oil temperature for a given amount of slip heat.

What is claimed is:

1. An automotive clutch provided with a cooling fin arrangement, the clutch comprising a surface exposed to a cooling fluid, the surface in heat conductive relation with a viscous fluid between at least two clutch elements, a plurality of cooling fins defining fluid channels for the flow of the cooling fluid between the fins effective to transfer heat from the viscous fluid to the cooling fluid, and protuberances on the surfaces of the cooling fins extending a distance into the cooling fluid flow effective to induce non-laminar flow therein, the protuberances having at least one edge oriented substantially perpendicular to the flow of the cooling fluid whereby a surface of said protuberances which is exposed to said fluid flow is arranged in angular relationship to said fluid flow, the non-laminar flow effective to increase the transfer of heat from the viscous fluid relative to the transfer of heat from the viscous fluid by a laminar flow through the channels.

2. The arrangement of claim 1, wherein said protuberances are formed integrally with the cooling fins.

3. The arrangement of claim 1, wherein said protuberances are formed by wires fastened to the surfaces of the cooling finds, the wires extending substantially perpendicular to the fluid flow.

4. The arrangement of claim 1, wherein the relative height of elevation of said protuberances from a general surface of said cooling fin is selected to assure that the fluid flow pattern of the cooling fluid through said cooling fins is turbulent.

5. The arrangement of claim 2, wherein said protuberances comprise individual balls oriented substantially perpendicular to the surface of the cooling fins and angled to the fluid flow.

6. A clutch cover comprising a containment of heat conductive material wherein an outer surface of said containment comprises cooling fins which extend over said outer surface and which represent a plurality of webs connected at one of their edges with said outer surface of said containment, said cooling fins extending essentially perpendicular therefrom, said cooling fins each having two faces, said web-like cooling fins comprising on at least one of their faces turbulence-creating formations effective to obtain a turbulent flow of a cooling fluid along surfaces forming channels created by adjacent webs, the formations having at least one edge oriented substantially perpendicular to the flow of the cooling fluid whereby a surface of said formations which is exposed to said fluid flow is arranaed in angular relationship to said fluid flow.

7. The containment of claim 6, which is a cover of a viscous fan clutch of a vehicle.

8. The containment of claim 7, wherein the cooling fluid is ambient air which impinges during movement of the vehicle axially on the cover of the fan clutch, whereafter it is directed radially outwards between cooling fins arranged radially outwardly from a central point.

9. A cover and viscous fan clutch assembly for dissipating heat from the cover to a cooling fluid flowing thereover, the assembly comprising:

a cover;

a viscous fan clutch;

a plurality of radially extending cooling means for cooling the cover having means for flowing the cooling fluid therebetween;

means for disrupting the cooling fluid flow in the flow means between cooling means effective to obtain a non-laminar flow of fluid, said means having at least one edge oriented substantially perpendicular to the flow of the cooling fluid whereby a surface of said means which is exposed to said fluid flow is arranged in angular relationship to said fluid flow.

10. A method for dissipating heat from a cover of a viscous fan clutch with a cooling fluid flow, the method comprising:

arranging a plurality of radially extending cooling fins on an outer surface of the cover to define a plurality of fluid channels therebetween through which the cooling fluid flows;

disrupting the cooling fluid flow in the fluid channels with a plurality of turbulence-creating formations disposed on the cooling fins and effective to induce non-laminar flow, the formations having at least one edge oriented substantially perpendicular to the flow of the cooling fluid whereby a surface of said formations which is exposed to said fluid flow is arranged in angular relationship to said fluid flow.

11. A method for dissipating heat according to claim 10, wherein the plurality of turbulence-creating formations comprise protrusions formed the surfaces of the cooling fins for creating the non-laminar flow of fluid.

12. A method for dissipating heat according to claim 11, wherein the protrusions comprise profiled bars extending generally perpendicular to the fluid flow.

13. A method for dissipating heat according to claim 10, wherein the viscous fan clutch comprises two clutch plates having a fluid therebetween and the disrupting of the fluid flow is effective to decrease the temperature of the fluid between the clutch plates.

* * * * *